US009296022B1

(12) United States Patent
Chen et al.

(10) Patent No.: US 9,296,022 B1
(45) Date of Patent: Mar. 29, 2016

(54) SONICATION CLEANING SYSTEM

(71) Applicant: WD Media, LLC, San Jose, CA (US)

(72) Inventors: Chaoyuan C. Chen, San Jose, CA (US); Bing-Shiuan Chang, San Jose, CA (US)

(73) Assignee: WD Media, LLC, San Jose, CA (US)

( * ) Notice: Subject to any disclaimer, the term of this patent is extended or adjusted under 35 U.S.C. 154(b) by 341 days.

(21) Appl. No.: 14/058,171

(22) Filed: Oct. 18, 2013

Related U.S. Application Data

(62) Division of application No. 12/823,780, filed on Jun. 25, 2010, now Pat. No. 8,584,687.

(51) Int. Cl.
*B08B 3/12* (2006.01)
*B08B 3/10* (2006.01)

(52) U.S. Cl.
CPC . *B08B 3/102* (2013.01); *B08B 3/12* (2013.01); *B08B 3/123* (2013.01)

(58) Field of Classification Search
CPC ..... B08B 3/12; B08B 3/123
USPC ..... 134/1, 18, 34, 42
See application file for complete search history.

(56) References Cited

U.S. PATENT DOCUMENTS

| | | | | |
|---|---|---|---|---|
| 4,902,350 | A | 2/1990 | Steck | |
| 8,584,687 | B1 | 11/2013 | Chen et al. | |
| 2003/0028287 | A1 | 2/2003 | Puskas | |
| 2004/0055621 | A1 * | 3/2004 | McDermott | B08B 3/12 134/1.3 |
| 2004/0144399 | A1 * | 7/2004 | McDermott | B08B 3/12 134/1 |
| 2005/0003737 | A1 * | 1/2005 | Montierth | A61B 8/546 451/5 |
| 2008/0000505 | A1 * | 1/2008 | McDermott | B08B 3/12 134/105 |
| 2008/0047575 | A1 | 2/2008 | Puskas | |

OTHER PUBLICATIONS

Office Action dated Feb. 12, 2013 in U.S. Appl. No. 12/823,780, 7 pages.
Notice of Allowance dated Jul. 23, 2013 in U.S. Appl. No. 12/823,780, 8 pages.

* cited by examiner

*Primary Examiner* — Saeed T Chaudhry

(57) ABSTRACT

A sonication cleaning system is provided. The sonication cleaning system includes a cleaning tank configured to contain a liquid and a flow control system configured to cause a gradient cross flow of the liquid through the cleaning tank. The system further includes a sonication generator configured to agitate the liquid in the cleaning tank and a controller configured to vary a power applied to the sonication generator to agitate the liquid in the cleaning tank based on an oscillation position of a workpiece within the cleaning tank.

9 Claims, 5 Drawing Sheets

SONICATION CLEANING SYSTEM

REFERENCE TO RELATED APPLICATIONS

This application is a divisional of U.S. patent application Ser. No. 12/823,780, filed Jun. 25, 2010, and entitled "SONICATION CLEANING SYSTEM", the entire content of which is incorporated herein by reference.

FIELD

The present disclosure generally concerns cleaning systems and, more particularly, wet cleaning systems used in a manufacturing environment.

BACKGROUND

During magnetic recording disk manufacturing, a disk surface may be exposed to various types of contaminants. Sources of contamination may include process gases, chemicals, deposition materials, liquids, etc. Contaminants may be deposited on a disk surface in particulate form. If contamination particles are not removed from the disk surface, the particles may interfere with subsequent manufacturing processes of the disk or ultimately interfere with operation of a hard drive containing the disk.

SUMMARY

According to one aspect of the present disclosure, a sonication cleaning system is described herein. The system includes a cleaning tank configured to contain a liquid and a flow control system configured to cause a gradient cross flow of the liquid through the cleaning tank. The system further includes a sonication generator configured to agitate the liquid in the cleaning tank and a controller configured to vary a power applied to the sonication generator to agitate the liquid in the cleaning tank based on an oscillation position of a workpiece within the cleaning tank.

According to another aspect of the present disclosure, a method for cleaning a workpiece in a sonication cleaning system is described herein. The method includes oscillating a workpiece between an upper position and a lower position in a cleaning tank containing a liquid and agitating the liquid in the cleaning tank with a sonication generator. The method further includes applying a power to the sonication generator to agitate the liquid that is varied based on the oscillation position of the workpiece in the cleaning tank and causing a gradient cross flow of the liquid through the cleaning tank.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components have been simplified or omitted from the figures to avoid obscuring the concepts of the subject technology.

Figure 1:
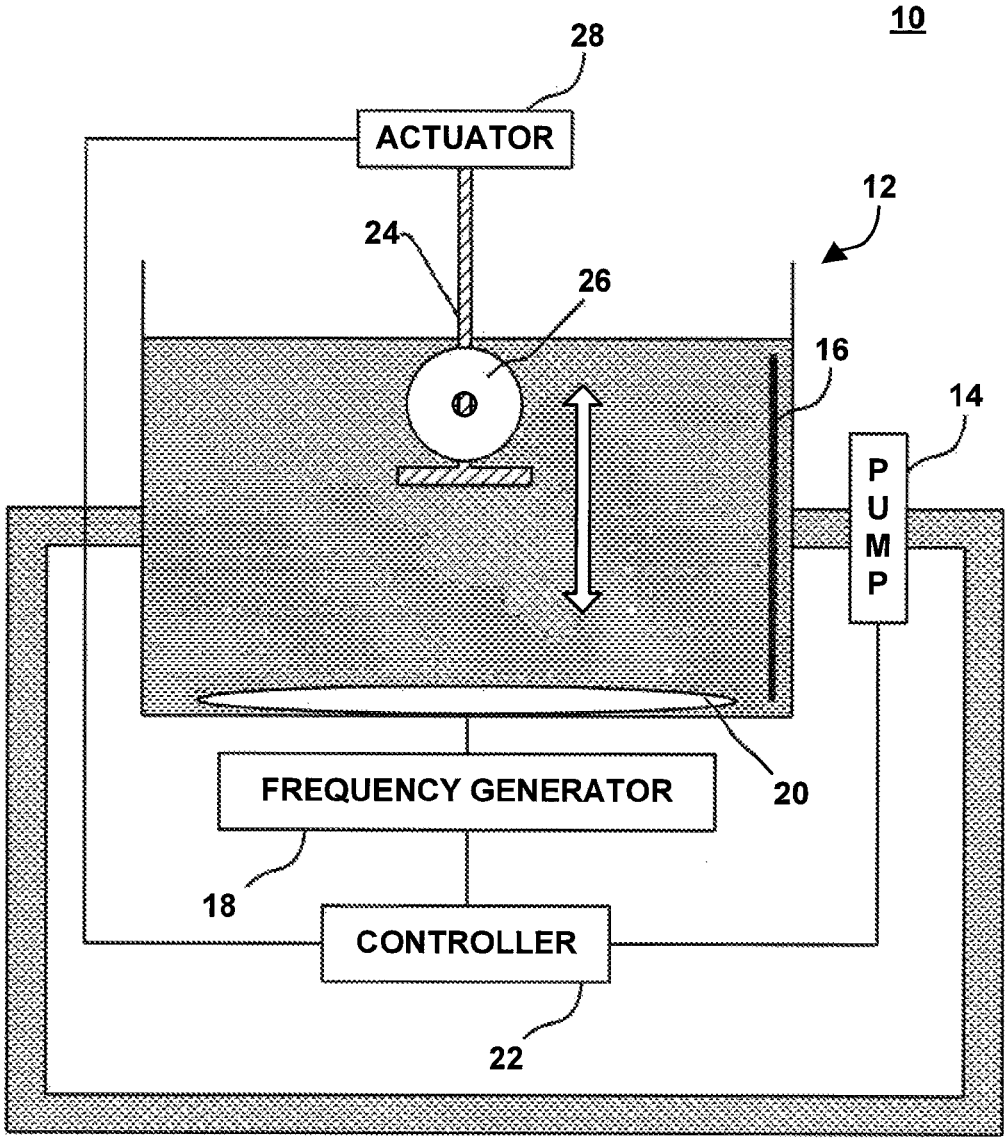
FIG. 1 is a diagram illustrating components of a sonication cleaning system according to one aspect of the subject technology.

FIG. 1 is a diagram illustrating components of a sonication cleaning system according to one aspect of the subject technology. As depicted in FIG. 1, sonication cleaning system 10 includes cleaning tank 12, pump 14, outlet plate 16, frequency generator 18, transducer 20, and controller 22. Pump 14 circulates a cleaning liquid through cleaning tank 12. Pump 14 pumps the cleaning liquid through outlet plate 16 to create a gradient cross flow of the cleaning liquid through cleaning tank 12. Transducer 20 is driven by frequency generator 18 to agitate the cleaning liquid in cleaning tank 12. Holder 24 supports workpiece 26, which is oscillated between an upper position and a lower position in cleaning tank 12 by actuator 28. Controller 22 monitors and controls the various components of sonication cleaning system 10 to effect cleaning of workpiece 26.

Sonication cleaning system 10 uses a combination of two cleaning mechanisms to remove contamination particles from the surface of workpiece 26. The first cleaning mechanism is sonication where the cleaning liquid in cleaning tank 12 is agitated by applying a sonication energy to the cleaning liquid. The sonication energy creates acoustic waves that travel through the cleaning liquid and impact the surface of workpiece 26 when submerged in the cleaning liquid. The impact of the acoustic waves on the surface of workpiece 26 dislodges contamination particles embedded in the surface of workpiece 26.

The sonication energy may be applied to the cleaning liquid in cleaning tank 12 when transducer 20 is driven by frequency generator 18, which together comprise a sonication generator. The sonication energy may be varied by controlling the frequency and/or the amplitude at which transducer 20 is driven. The driving frequency may be hundreds of kHz (i.e., ultrasonic) up to thousands of kHz (i.e., megasonic). Ultrasonic cleaning produces more random cavitations in the cleaning liquid, while megasonic cleaning produces more controlled cavitations in the cleaning liquid. Those skilled in the art will recognize that the subject technology is not limited to any particular frequency or amplitude when applying the sonication energy to the cleaning liquid.

The second cleaning mechanism used in sonication cleaning system 10 is a cross flow of the cleaning liquid over the surface of workpiece 26 and through cleaning tank 12. The cross flow of the cleaning liquid carries dislodged contamination particles away from workpiece 26. The cleaning liquid may be circulated out of cleaning tank 12, through a filter to trap and remove the contamination particles, and back into cleaning tank 12.

When used in combination, the two cleaning mechanisms may offset one another and reduce the overall cleaning efficiency of the system. For example, as the sonication energy is increased, the ability to remove embedded contamination particles from the surface of the workpiece increases. However, as the sonication energy is increased, the acoustic waves or cavitations in the cleaning liquid disrupt cross flow of the cleaning liquid across the surface of the workpiece. This disruption may decrease the ability of the cross flow to carry the dislodged contamination particles away from the workpiece and increases the likelihood that the contamination particles may be redeposited on the surface of the workpiece. Similarly, as the cross flow of the cleaning liquid is increased, the ability to remove dislodged contamination particles from the workpiece increases. However, the increased cross flow of the cleaning liquid disrupts the sonication energy that reaches the surface of the workpiece. This disruption may reduce the effectiveness of the sonication energy to dislodge contamination particles from the surface of the workpiece.

The subject technology creates multiple cleaning zones within cleaning tank 12 to take advantage of the strengths of the two cleaning mechanisms discussed above while balancing some of the weaknesses of using these cleaning mechanisms in combination. For example, cleaning tank 12 may include an upper cleaning zone and a lower cleaning zone through which workpiece 26 travels as workpiece 26 is oscillated between an upper position and a lower position in cleaning tank 12. As workpiece 26 is oscillated through the lower cleaning zone, the sonication energy applied to agitate the cleaning liquid may be increased and the cross flow of the cleaning liquid may be decreased to improve particle removal efficiency of the system. As workpiece 26 is oscillated through the upper cleaning zone, the cross flow of the cleaning liquid may be increased and the sonication energy applied to agitate the cleaning liquid may be decreased to evacuate the dislodged contamination particles and reduce the occurrence of particle redeposition on the surface of workpiece 26. To improve throughput of the system, workpiece 26 may be continuously oscillated between the upper position and the lower position rather than employing a dwell period where workpiece 26 remains stationary within either the upper cleaning zone or the lower cleaning zone for a period of time before moving to the other cleaning zone.

Figure 2A:
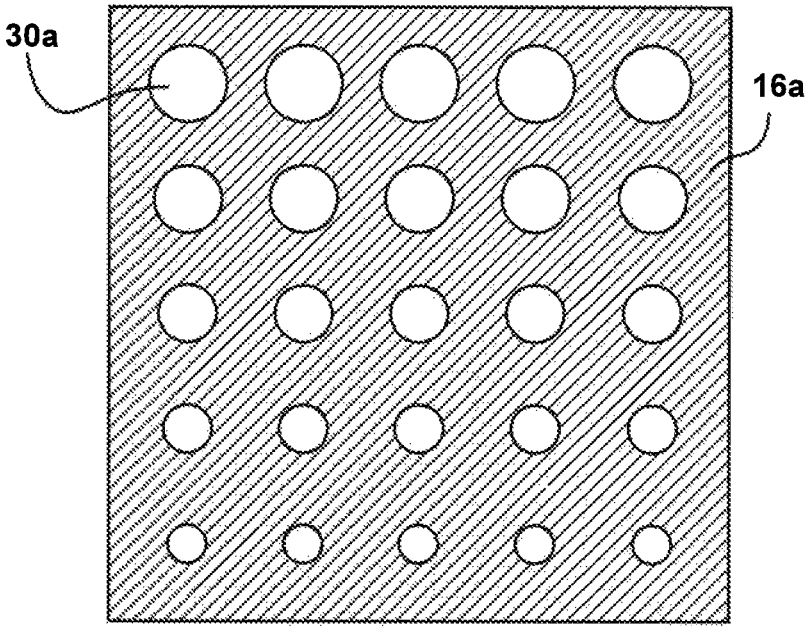
FIGS. 2A and 2B are diagrams illustrated outlet plates according to different aspects of the subject technology.
Figure 2B:
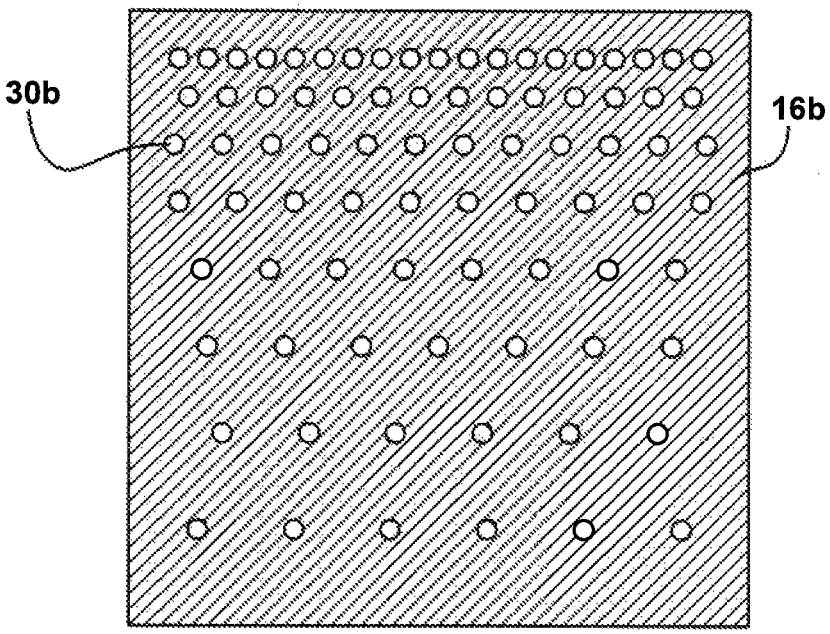

Pump 14 and outlet plate 16, together comprising a flow control system, are configured to cause a gradient cross flow of the cleaning liquid through cleaning tank 12. As noted above, pump 14 may be configured to circulate the cleaning liquid through cleaning tank 12, out of cleaning tank 12, through a filter (not shown) to capture and remove contamination particles from the cleaning liquid, and back into cleaning tank 12. In order to vary the cross flow of the cleaning liquid within the cleaning zones of cleaning tank 12, pump 14 may pump the cleaning liquid through outlet plate 16 to create a gradient cross flow of the cleaning liquid through cleaning tank 12. FIGS. 2A and 2B illustrate examples of outlet plates according to different aspects of the subject technology.

FIG. 2A illustrates outlet plate 16*a* having a number of openings 30*a* arranged to allow cleaning liquid to be pumped through outlet plate 16*a* by pump 14. As depicted in FIG. 2A, the diameter or area of openings 30*a* varies depending on the location within outlet plate 16*a*. For example, the diameter or area of openings 30*a* in an upper portion of outlet plate 16*a* is larger than the diameter or area of openings 30*a* in a lower portion of outlet plate 16*a*. The diameter or area of openings 30*a* gradually decreases from that of openings 30*a* in the upper portion to that of openings 30*a* in the lower portion of outlet plate 16*a*. As the cleaning liquid is pumped through outlet plate 16*a*, a gradient cross flow is created with the different portions of outlet plate 16*a* causing a flow rate higher than the portions below, which have progressively smaller openings 30*a*, and lower than the portions above, which have progressively larger openings 30*a*.

FIG. 2B illustrates outlet plate 16*b* having a number of openings 30*b* arranged to allow cleaning liquid to be pumped through outlet plate 16*b* by pump 14. Unlike openings 30*a* shown in FIG. 2A, openings 30*b* are uniform in diameter or area. To create a gradient cross flow of the cleaning liquid pumped through outlet plate 16*b*, the density of openings 30*b* arranged in outlet plate 16*b* is varied based on position in outlet plate 16*b*. For example, the density of the openings 30*b* in an upper portion of outlet plate 16*b* is higher than the density of the openings 30*b* in a lower portion of outlet plate 16*b*. By gradually decreasing the density of the openings 30*b* from the upper portion of outlet plate 16*b* to the lower portion of outlet plate 16*b*, a gradient cross flow is created with each portion of outlet plate 16*b* causing a flow rate of the cleaning liquid higher than the portions below, which have a progressively smaller density of openings 30*b*, and lower than the portions above, which have a progressively higher density of openings 30*b*.

Either outlet plate 16*a* or outlet plate 16*b* cause a gradient cross flow of the cleaning liquid across cleaning tank 12 with a higher flow rate of the cleaning liquid in the upper portion of cleaning tank 12 and a lower flow rate of the cleaning liquid in the lower portion of cleaning tank 12. In this manner, when workpiece 26 is oscillated through the upper cleaning zone dislodged particles are effectively flushed away from the surface of workpiece 26 using the higher flow rate of the cleaning liquid. Conversely, when workpiece 26 is oscillated through the lower cleaning zone the reduced flow rate of the cleaning liquid reduces the negative impact on the effectiveness of the sonication energy dislodging contamination particles embedded in the surface of workpiece 26.

The flow rate of the cleaning liquid across cleaning tank 12 may vary from 1 up to 100 liters per minute. Furthermore, the gradient of the cross flow of the cleaning liquid caused by outlet plate 16 may cause the flow rate of the cleaning liquid from the lower portion of outlet plate 16 to be as low as 50% of the flow rate of the cleaning liquid from the upper portion of outlet plate 16. The flow control system, comprising pump 14 and outlet plate 16, may further include a proportional valve operable to vary the overall flow rate of the cleaning liquid through cleaning tank 12. The subject technology is not limited to the flow rates nor the percentage reduction in flow rate across the cross flow gradient noted above.

The cleaning liquid may be any of a number of liquids suitable for cleaning workpiece surfaces. The cleaning liquid may include deionized water, alcohols, detergents, wetting agents, solvents, solutes, etc. The subject technology is not limited to any particular cleaning liquid and the cleaning liquid used may vary depending on the type of workpiece and the expected type of contamination particles.

FIG. 1 depicts a single outlet plate 16 arranged in cleaning tank 12 adjacent to an outlet of pump 14. The subject technology is not limited to the use of a single outlet plate 16 within cleaning tank 12. For example, a second outlet plate (not shown) may be arranged on the opposite side of cleaning tank 12 adjacent to an outlet port of cleaning tank 12 where the cleaning liquid exits cleaning tank 12 to be filtered for removing contamination particles suspended therein before pump 14 returns the cleaning liquid to cleaning tank 12. The second outlet plate may have openings corresponding in arrangement and size to the openings in outlet plate 16 to help control and maintain the gradient cross flow of the cleaning liquid through cleaning tank 12. Additionally, one or more intermediate outlet plates (not shown) having similar openings arranged therein may be arranged at intermediate positions within cleaning tank 12 to further help control and maintain the gradient cross flow of the cleaning liquid through cleaning tank 12.

Figure 3:
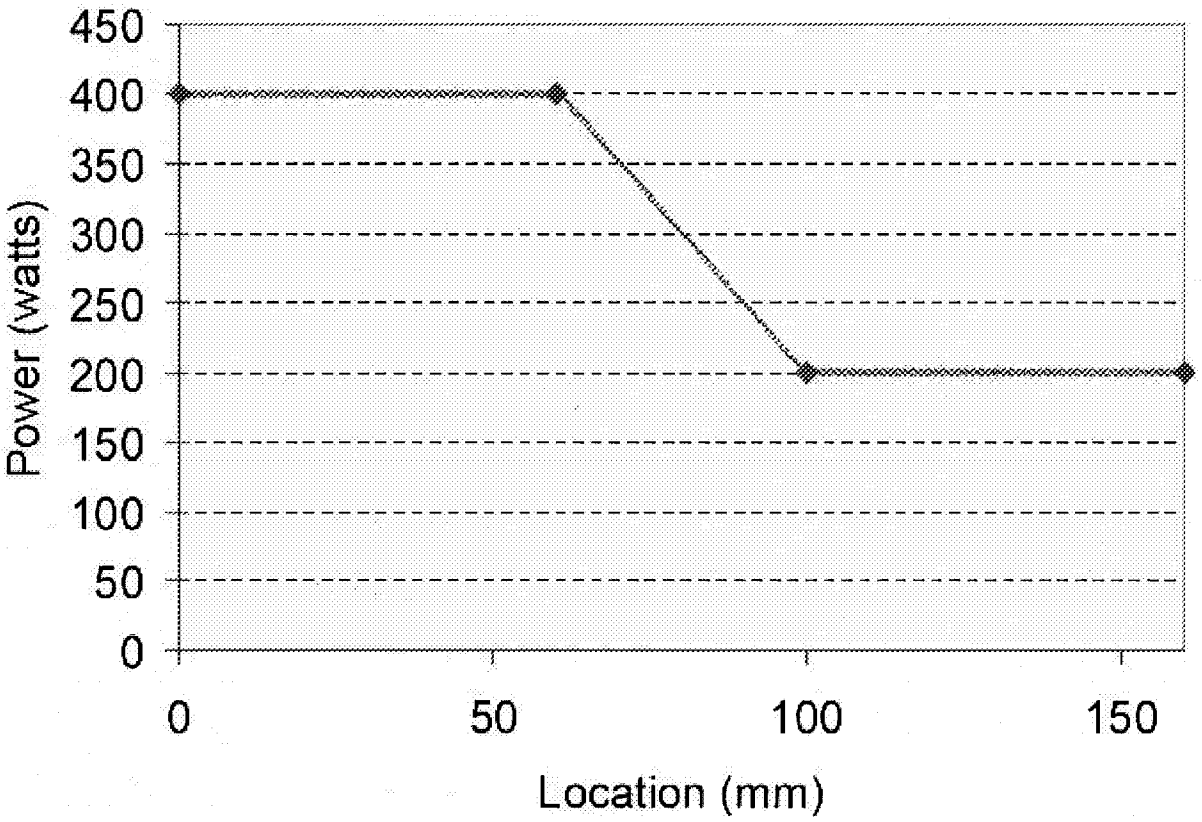
FIG. 3 is a graph illustrating a sonication power curve according to one aspect of the subject technology.

FIG. 3 is a graph illustrating a sonication power curve according to one aspect of the subject technology. The x-axis of the graph represents the location of a workpiece in an oscillation cycle with the origin representing the lowest position of the workpiece in the oscillation cycle and 150 mm representing the highest position of the workpiece in the oscillation cycle. The y-axis represents the sonication power applied by the sonication generator, comprising transducer 20 and frequency generator 18, to the cleaning liquid within cleaning tank 12. FIG. 3 illustrates one example of the sonication energy or power applied to the cleaning liquid being varied based on an oscillation position of workpiece 26 within cleaning tank 12. The distance represented in FIG. 3 of 150 mm from the lowest position to the highest position in the oscillation cycle is only one example. The distance between the lowest position and the highest position in the oscillation cycle may be longer than 150 mm or shorter than 150 mm depending on the size of cleaning tank 12, the size of the workpiece, a desired amount of travel of the workpiece within cleaning tank 12, etc.

The sonication power curve depicted in FIG. 3 may be divided into three zones. A first zone includes positions of workpiece 26 between 0 mm and 60 mm in the oscillation cycle. This first zone includes the lower cleaning zone within cleaning tank 12. While workpiece 26 moves between 0 mm and 60 mm in the oscillation cycle, the sonication generator applies 400 watts of power to agitate the cleaning liquid in cleaning tank 12 and dislodge contamination particles embedded in the surface of workpiece 26. As discussed above, the gradient cross flow of the cleaning liquid through cleaning tank 12 produces a relatively small flow rate of the cleaning liquid in the lower portions of cleaning tank 12 forming the lower cleaning zone.

Figure 4A:
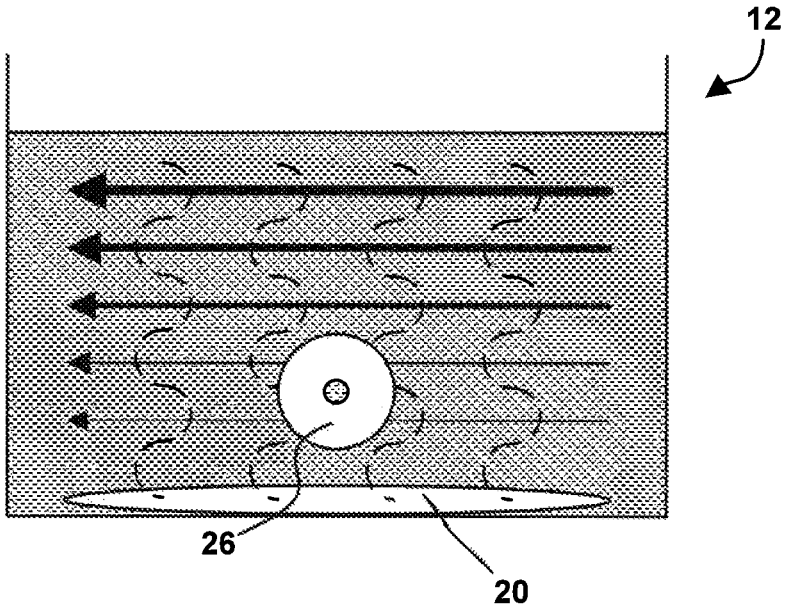
FIGS. 4A and 4B are diagrams illustrating operational configurations of a sonication cleaning system according to different aspects of the subject technology.

FIG. 4A is a diagram illustrating an operational configuration of sonication cleaning system 10 when workpiece 26 is located within the lower cleaning zone within cleaning tank 12 during an oscillation cycle. The gradient cross flow of the cleaning liquid within cleaning tank 12 is represented by the arrows extending from one side to the other side of cleaning tank 12. The overall size of the arrows is varied to represent the different flow rates within the gradient cross flow. As discussed above, the flow rate is higher in the upper portion of cleaning tank 12 than in the lower portion of cleaning tank 12. The sonication energy or power applied by the sonication generator is represented in FIG. 4A by the wavy lines extending from transducer 20 arranged in the bottom of cleaning tank 12.

Returning to FIG. 3, a second zone includes positions of workpiece 26 between about 60 mm and 100 mm in the oscillation cycle. The second zone represents a transition zone as workpiece 26 travels from the lower cleaning zone to the upper cleaning zone within cleaning tank 12. As workpiece 26 travels through the second zone of the oscillation cycle, the sonication energy or power applied by the sonication generator to the cleaning liquid is gradually reduced from 400 watts to 200 watts. The distance within the oscillation cycle comprising the second zone may be larger or smaller than the 40 mm of travel illustrated in FIG. 3. In addition, the sonication power applied may be gradually lowered in the second zone by more or less than the 200 watts represented in FIG. 3. The amount of power reduction and the rate at which power may be reduced in the second zone may be limited by physical limitations of the sonication generator. In addition, the amount of power reduction and the rate at which power may be reduced may be limited to a value and rate which minimizes turbulence in the cleaning liquid caused by the transition.

A third zone includes positions of workpiece 26 between 100 mm and 160 mm in the oscillation cycle. This third zone includes the upper cleaning zone within cleaning tank 12. While workpiece 26 moves between 100 mm and 160 mm in the oscillation cycle, the sonication generator applies an amount of power to the cleaning liquid reduced to 200 watts from the 400 watts applied in the first zone. As discussed above, a gradient cross flow of the cleaning liquid through cleaning tank 12 produces a relatively large flow rate of the cleaning liquid in the upper portions of cleaning tank 12 forming the upper cleaning zone. The subject technology is not limited to a range of 200 to 400 watts. The upper power value may be greater or less than 400 watts and the lower power value may be greater or less than 200 watts.

Figure 4B:
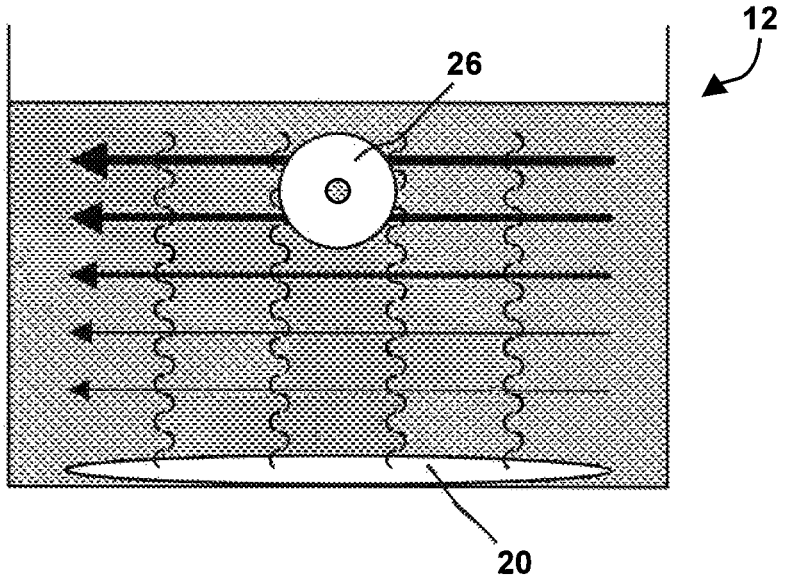

FIG. 4B is a diagram illustrating an operational configuration of sonication cleaning system 10 when workpiece 26 is located within the upper cleaning zone within cleaning tank 12 during an oscillation cycle. The gradient cross flow of the cleaning liquid within cleaning tank 12 is represented by the arrows extending from one side to the other side of cleaning tank 12. The overall size of the arrows is varied to represent the different flow rates within the gradient cross flow. As discussed above, the flow rate is higher in the upper portion of cleaning tank 12 than in the lower portion of cleaning tank 12. The sonication energy or power applied by the sonication generator is represented in FIG. 4B by the wavy lines extending from transducer 20 arranged in the bottom of cleaning tank 12.

Comparing FIG. 4A to FIG. 4B, the sonication energy or power applied by the sonication generator to the cleaning liquid is greater when workpiece 26 is in the lower cleaning portion of cleaning tank 12 (the first zone in FIG. 3), represented by the wavy lines in FIG. 4A being larger than the wavy lines in FIG. 4B. In addition, the flow rate with the gradient cross flow of the cleaning liquid is higher in the upper cleaning portion of cleaning tank 12 (the third zone in FIG. 3) than in the lower cleaning portion of cleaning tank 12, represented by arrows increasing in size from the lower cleaning portion to the upper cleaning portion of cleaning tank 12.

Returning to FIG. 1, holder 24 is configured to support workpiece 26 within cleaning tank 12. Actuator 28 is configured to oscillate holder 24 and workpiece 26 so that workpiece 26 travels between an upper position and a lower position, as discussed above and represented in FIG. 1 by the double-ended arrow. The subject technology is not limited to any particular system or mechanism for moving workpiece 26 into cleaning tank 12 and oscillating workpiece 26 between an upper position and a lower position within cleaning tank 12. Those skilled in the art will recognize various mechanisms used within manufacturing environments suitable for supporting and moving workpiece 26.

FIG. 1 depicts a single workpiece being supported by holder 24. The subject technology is not limited a single workpiece being oscillated at a time. Holder 24 may be configured to support multiple workpieces for simultaneously moving the workpieces through oscillation cycles within cleaning tank 12. Workpiece 26 represents any of a number items requiring cleaning at different manufacturing stages. For example, workpiece 26 may represent a magnetic recording disk, substrates, semiconductor wafers, photomasks, optical disks, glass substrates, flat panel display surfaces, etc.

As mentioned above, controller 22 monitors and controls components of sonication cleaning system 10 to effect cleaning of workpiece 26. Controller 22 may be in communication with pump 14 to control the operation of the flow control system to cause the gradient cross flow of cleaning liquid through cleaning tank 12 in the manner discussed above. Controller 22 may be in communication with frequency generator 18 to control the sonication energy or power applied to the cleaning liquid within cleaning tank 12 to agitate the cleaning liquid. Controller 22 may be in communication with actuator 28 to control and/or monitor the oscillation of workpiece 26 between an upper position and lower position within cleaning tank 12.

Figure 5:
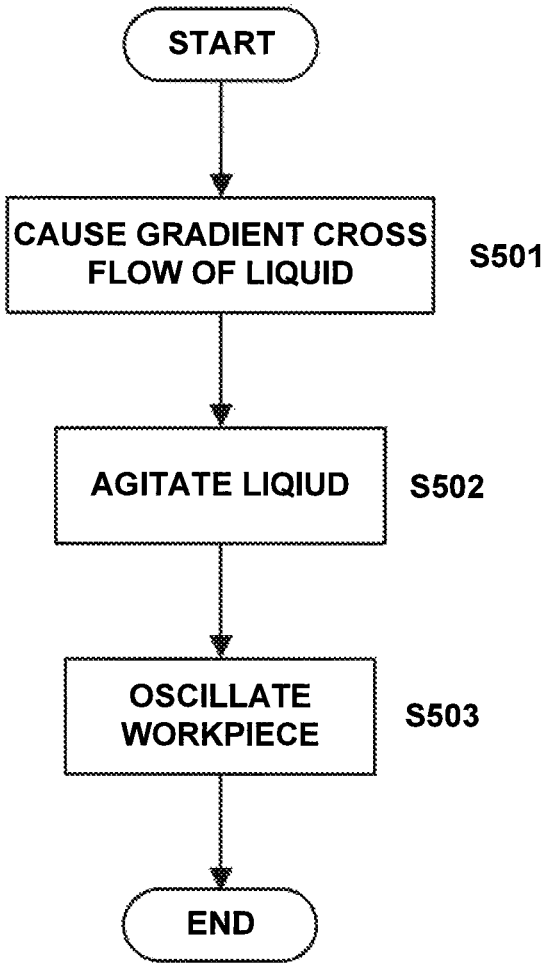
FIG. 5 is a flowchart illustrating a method for cleaning a workpiece according to one aspect of the subject technology.

Controller 22 represents any control system capable of executing one or more sequences of instructions for monitoring and controlling the operation of sonication cleaning system 10. Controller 22 may be a programmable logic controller or a general purpose computer comprising instructions stored on a computer/machine readable medium. FIG. 5 is a flowchart illustrating a method for cleaning a workpiece according to one aspect of the subject technology. The method illustrated in FIG. 5 may be implemented by controller 22 executing one or more sequences of instructions.

The method illustrated in FIG. 5 may be employed at various stages of manufacturing. For example, sonication cleaning system 10 may be used for post sputter wet cleaning of magnetic recording disks. Alternatively, sonication cleaning system 10 may be used in a pre-sputter wet cleaning stage. The subject technology is not limited to any particular manufacturing stage and may be used to clean workpieces at other pre or post sputter manufacturing stages.

Referring to FIG. 5, a gradient cross flow of cleaning liquid in cleaning tank 12 is caused in step S501 using the flow control system discussed above. In step S502, the cleaning liquid in cleaning tank 12 is agitated using the sonication generator in the manner described above. In step S503, workpiece 26 is oscillated between an upper position and a lower position within cleaning tank 12 to move workpiece 26 through both the upper and lower cleaning zones during each oscillation cycle.

Actuator 28 may be configured and/or controlled by controller 22 to oscillate workpiece 26 between the upper position and the lower position within cleaning tank 12 at a rate of 1 Hz. The subject technology is not limited to this rate and workpiece 26 may be oscillated between the upper position and lower position at a rate greater than 1 Hz or less than 1 Hz. It is noted that the rate of oscillation and the distance between the upper and lower positions within cleaning tank 12 dictates how fast workpiece 26 travels through the cleaning liquid while oscillating. The travel through the cleaning liquid in the oscillation direction provides a shear force beyond that provided by the gradient cross flow of the cleaning liquid for removing contamination particles from on or near workpiece 26.

The oscillation of workpiece 26 may continue for a predetermined period of time. For example, a first cleaning operation may involve oscillating workpiece 26 between the upper and lower cleaning zones within cleaning tank 12 for one minute. The duration of the cleaning operation may be greater or less than one minute. After a first cleaning operation, a second cleaning operation may be performed on workpiece 26 using a second sonication power curve different from a first sonication power curved applied during the first cleaning operation. For example, the second sonication power curve may be shifted up compared to the first sonication power curve. The shift may be a uniform amount across the curve, such as a 20 watt increase for the entire curve. Alternatively, the shift may not be uniform across the entire curve. For example, the second sonication power curve may be shifted up by a specified percentage across the curve. The percentage shift may be as high as 25% but is generally between 5% and 10%. In addition to shifting the sonication power curve, the locations and durations of the first, second, and third zones within the curve also may be modified in subsequent cleaning operations. The amount of particles removed from workpiece 26 may be monitored and used to determine whether to perform additional cleaning operations and/or to shift the sonication power curve applied in subsequent cleaning operations.

The previous description is provided to enable a person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A method for cleaning a workpiece in a sonication cleaning system, the method comprising:

oscillating a workpiece between an upper position and a lower position in a cleaning tank containing a liquid;

agitating the liquid in the cleaning tank with a sonication generator, wherein a power applied to the sonication generator to agitate the liquid is varied based on the oscillation position of the workpiece in the cleaning tank; and causing a gradient cross flow of the liquid through the cleaning tank.

2. The method according to claim 1, wherein oscillating the workpiece comprises continuously oscillating the workpiece between the upper and lower positions in the cleaning tank.

3. The method according to claim 1, wherein the power applied to the sonication generator when the workpiece is in the lower position in the cleaning tank is greater than the power applied to the sonication generator when the workpiece is in the upper position in the cleaning tank.

4. The method according to claim 1, wherein agitating the liquid in the cleaning tank comprises agitating the liquid with a transducer at a frequency and amplitude generated by a frequency generator.

5. The method according to claim 1, wherein causing a gradient cross flow of the liquid in the cleaning tank comprises pumping the liquid through a plurality of openings arranged in an outlet plate arranged in the cleaning tank.

6. The method according to claim 5, wherein the plurality of openings in the outlet plate gradually decrease in size from the upper portion of the outlet plate to the lower portion of the outlet plate, and wherein pumping the liquid through the plurality of openings causes a flow rate of the liquid in an upper portion of the cleaning tank to be greater than a flow rate of the liquid in a lower portion of the cleaning tank.

7. The method according to claim 5, wherein a density of the plurality of openings arranged in the outlet plate decreases from an upper portion of the outlet plate to a lower portion of the outlet plate, and wherein pumping the liquid through the plurality of openings causes a flow rate of the liquid to decrease from an upper portion of the cleaning tank to a lower portion of the cleaning tank.

8. The method according to claim 1, wherein the power is applied to the sonication generator according to a first power curve during a first cleaning cycle and according to a second power curve during a second cleaning cycle, wherein the second power curve is greater than the first power curve.

9. The method according to claim 1, wherein the causing the gradient cross flow of the liquid through the cleaning tank comprises causing the gradient cross flow of the liquid through the cleaning tank such that a flow rate of the liquid in a first portion of the cleaning tank is different than a flow rate of the liquid in a second portion of the cleaning tank.

* * * * *